US006427342B1

(12) United States Patent
Breitbarth et al.

(10) Patent No.: US 6,427,342 B1
(45) Date of Patent: Aug. 6, 2002

(54) LIGHTWEIGHT CHAIN SAW BAR

(75) Inventors: Robert H. Breitbarth; David Scott Penrose, both of Estacada, OR (US)

(73) Assignee: Blount, Inc., Portland, OR (US)

( * ) Notice: Subject to any disclaimer, the term of this patent is extended or adjusted under 35 U.S.C. 154(b) by 0 days.

(21) Appl. No.: 09/650,426

(22) Filed: Aug. 29, 2000

(51) Int. Cl.[7] ..... B27B 17/02
(52) U.S. Cl. ..... 30/387; 30/383
(58) Field of Search ..... 30/381, 383, 387; 76/112; 83/821

(56) References Cited

U.S. PATENT DOCUMENTS

| | | | | |
|---|---|---|---|---|
| 3,191,646 A | | 6/1965 | Merz | 30/387 |
| 3,250,304 A | | 5/1966 | Merz | 30/387 |
| 4,393,590 A | | 7/1983 | Pantzar | 30/387 |
| 4,837,934 A | | 6/1989 | Krohn | 30/387 |
| 4,885,843 A | | 12/1989 | Kelsay, III et al. | 30/387 |
| 5,025,561 A | * | 6/1991 | Sugihara et al. | 30/387 |
| 5,050,303 A | | 9/1991 | Sinclair et al. | 30/383 |
| 5,249,363 A | * | 10/1993 | Mitrega et al. | 30/387 |
| 5,271,157 A | * | 12/1993 | Wieninger et al. | 30/387 |
| 5,842,279 A | * | 12/1998 | Andress et al. | 30/387 |

FOREIGN PATENT DOCUMENTS

| | | | | |
|---|---|---|---|---|
| CA | 657445 | * | 2/1963 | 30/387 |
| GB | 1084144 | * | 9/1967 | 30/387 |

* cited by examiner

*Primary Examiner*—Hwel-Slu Payer
(74) *Attorney, Agent, or Firm*—Klarquist Sparkman, LLP

(57) ABSTRACT

A guide bar for a chain saw is provided having an elongate substantially planar main body portion made from a first material and having an opening extending therethrough. An elongate insert made from a second material is configured to fit closely in the opening in the main body portion. The main body portion has a holding mechanism for retaining an end portion of the insert to inhibit release of the end portion of the insert laterally of the main body portion.

44 Claims, 5 Drawing Sheets

LIGHTWEIGHT CHAIN SAW BAR

FIELD OF THE INVENTION

The present invention relates to a guide bar for a chain saw, and more particularly to a guide bar which has a reduced weight.

BACKGROUND OF THE INVENTION

Chain saws are used extensively in the logging industry. Since they must often be used in rough and remote terrain, it is important that the chain saw be as light in weight as possible, yet rugged and durable for the hard use it will encounter.

The chain saw generally will include a motor head, from the forward part of which extends an elongate, substantially planar guide bar, about which a saw chain is driven for cutting. Since the guide bar extends some distance forwardly of the motor head, its weight can produce a very tiring effect on a user. For this reason, it is desirable to provide as light a guide bar as possible.

In the past, efforts have been made to produce light weight guide bars. Such prior efforts have included bars with honeycomb or foam centers having outer metal laminates secured thereto, or providing a synthetic insert in an opening in the center of the bar. Since the materials used previously may not be as durable as metal and may be more expensive, they have not been as successful as desired.

SUMMARY OF THE INVENTION

It is an object of the present invention to provide an improved chain saw guide bar which has a reduced weight, yet which provides good durability and toughness for extended use.

Another object of the present invention is to provide a reduced weight guide bar for a chain saw which will function in a manner similar to prior guide bars, yet which will be sufficiently reduced in weight that it will provide greater ease of use for an operator.

More specifically, an object of the present invention is to provide a chain saw guide bar which has a main body portion having opposed side faces, a rear end, a forward end, elongate upper and lower edges providing a peripheral guide edge for guiding a loop of saw chain, and having an elongate opening extending laterally therethorough intermediate the rear and forward ends and the upper and lower edges, with the opening having opposed forward and rear ends and elongate upper and lower reaches. The main body portion is made from a first metal, such as high-grade steel. An elongate insert made from a second, lighter weight metal, such as aluminum, is configured to fit closely in the opening in the main body portion, with the insert having forward and rear end portions directed toward the forward and rear ends of the main body portion. The main body portion has a holding mechanism at an end of the opening for retaining an end portion of the insert to inhibit release of the end portion of the insert from the main body portion laterally of the main body portion.

A benefit of such construction is that the main body portion will have sufficient strength, durability, and toughness to support a saw chain driven thereabout for cutting, and the lighter weight metal insert provides weight reduction without adversely altering necessary operating characteristics of the saw bar.

A further object of the present invention is to provide a chain saw guide bar having a main body portion made of first metal material, an insert of a lighter weight second metal material disposed in an elongate opening in the main body portion, the main body portion having a socket formed at an end of the opening intermediate opposed side faces of the main body portion, and the insert having a protrusion extending longitudinally from remainder portions of the insert, which protrusion is received in the socket to inhibit release of the end portion of the insert from the main body portion laterally of the guide bar. With such structure, flexing of the guide bar during use will not result in the end of the insert releasing from the main body portion of the guide bar as might otherwise occur if the end portion of the insert were not so captured.

A still further object of the present invention is to provide a chain saw guide bar with a main body portion having an elongate opening formed therein with an insert of a lighter weight material configured to fit closely in the opening and be held therein, wherein the insert comprises a first insert section and a second insert section, each of which are substantially planar and are disposed in face-to-face contact with each other in the opening. The two insert sections together have a combined thickness which is no greater than the thickness of the main body portion, allowing the guide bar to have a reduced weight and still function to cut a kerf of a width no greater than that of which a usual saw bar would allow.

A still further object of the present invention is to provide such a guide bar having first and second insert sections in which each of the insert sections has a protrusion at its opposite ends which fit into sockets on the main body portion at opposite ends of the opening to hold opposite ends of the insert sections to the main body portion and inhibit release of the insert sections laterally from the main body portion.

Yet another object of the present invention is to provide a reduced weight chain saw guide bar wherein the first and second insert sections have contiguous inner faces which contact each other along a plane paralleling and disposed substantially centrally between opposed outer faces of the main body portion and the first and second insert sections are secured to each other.

A still further object of the present invention is to provide a novel method for producing a reduced weight chain saw guide bar having a main body portion with an elongate opening extending therethrough and an insert of a lighter weight material secured therein in such a manner that the insert is held firmly in the main body section.

These and other objects and advantages of the present invention will be apparent from the following detailed description of preferred embodiments thereof and from the attached drawings.

DETAILED DESCRIPTION OF PREFERRED EMBODIMENTS

Figure 1:
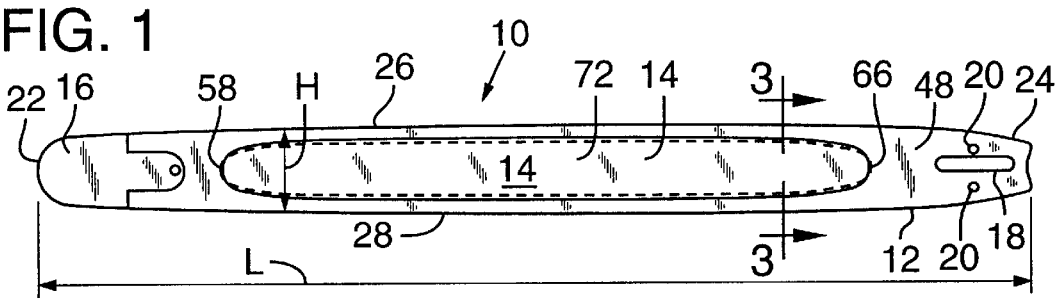
FIG. 1 is a side elevation view of a chain saw guide bar constructed according to an embodiment of the invention.
Figure 2:
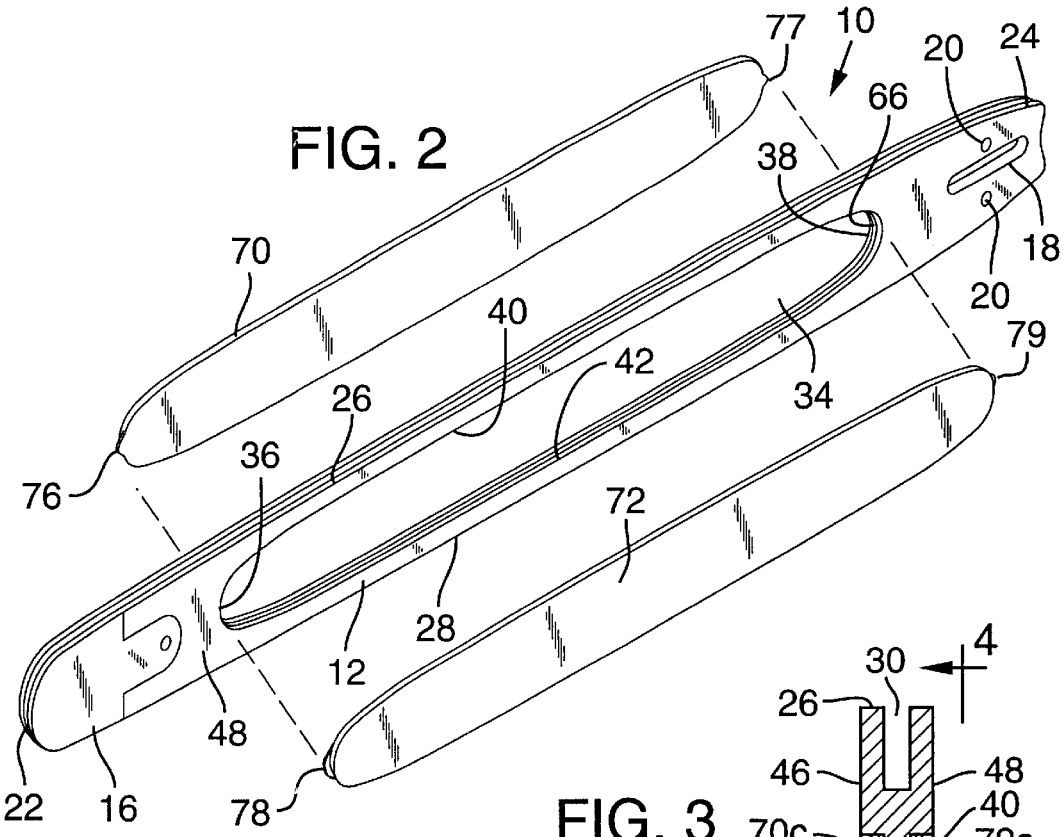
FIG. 2 is an exploded perspective view of the chain saw guide bar of claim 1.

Referring to FIGS. 1 and 2, at 10 is indicated generally a chain saw guide bar constructed according to a preferred embodiment of the invention. The guide bar includes a main body portion 12 and insert 14. The main body portion has a replaceable nose assembly 16 at its forward end. At its rear end it has an elongate mounting slot 18 through which bolts may extend to secure the guide bar to a power head (not shown). Oil holes 20 near the rear end of the guide bar permit introduction of oil from the power head to the bar for lubrication of the saw chain during use.

Although the illustrated embodiment is shown as a bar having a replaceable nose assembly at its forward end, it should be recognized that the invention set out herein may be used with many forms of chain saw guide bars. This would include bars which do not have replaceable nose assemblies, solid nose bars, and sprocket nose bars.

Figure 3:
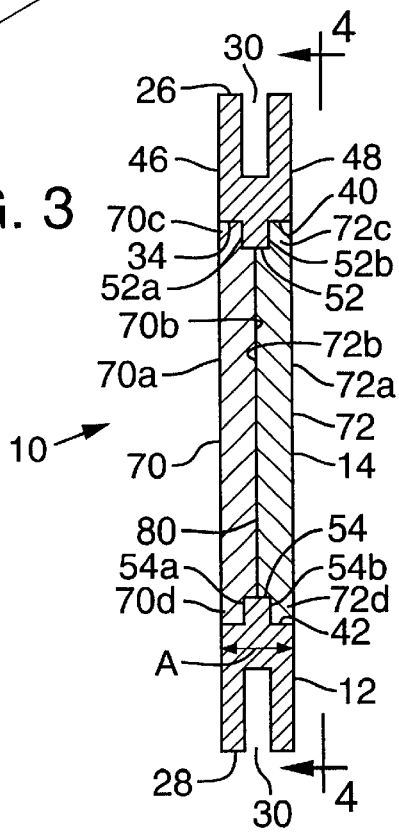
FIG. 3 is an enlarged cross-sectional view taken generally along the line 3—3 in FIG. 1.
Figure 4:
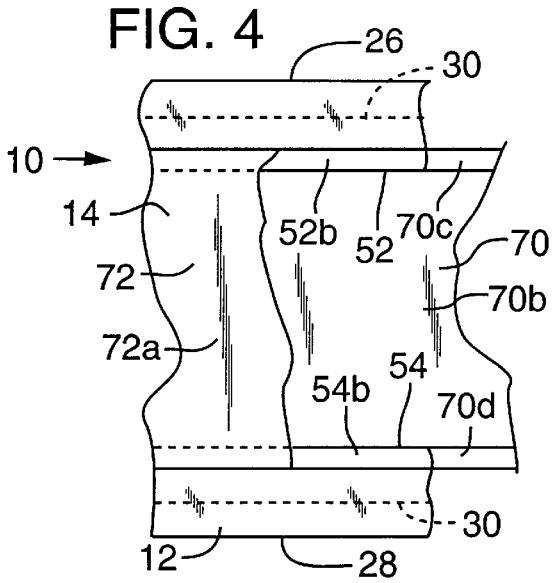
FIG. 4 is a side elevation view of a portion of the bar, taken along the line 4—4 in FIG. 3 with portions broken away.

The forward end of the main body portion is indicated at 22, and the rear end is indicated at 24. Elongate upper and lower edges, 26 and 28, respectively, extend longitudinally of the bar between the rear and forward ends. As best seen in FIG. 3, the usual guide groove 30 is provided in the peripheral edge of the main body portion, providing a peripheral guide edge for guiding a loop of saw chain to and around the forward end of the guide bar and back to the rear end. The main body portion is made from a first material, such as a high-grade steel commonly used for chain saw guide bars.

Referring more particularly to FIG. 2, an elongate opening 34 extends laterally and fully through the main body portion intermediate the rear and forward ends and the upper and lower edges of the main body portion. The opening has opposed forward and rear ends, 36 and 38 respectively, and elongate upper and lower reaches 40 and 42, respectively. As is best seen in FIG. 2, forward end 36 of the opening is spaced longitudinally inwardly from the forward end 22 of the main body portion. Rear end 38 is spaced longitudinally inwardly from the rear end 24 of the main body portion. Upper and lower reaches 40, 42, are spaced inwardly from upper and lower edges 26, 28 of the main body portion, respectively.

The main body portion has opposed outwardly facing side surfaces 46, 48, which are substantially planar and parallel to each other. Side surfaces 46, 48 are spaced apart a distance A which defines the thickness of the main body portion (see FIG. 3).

Figure 5:
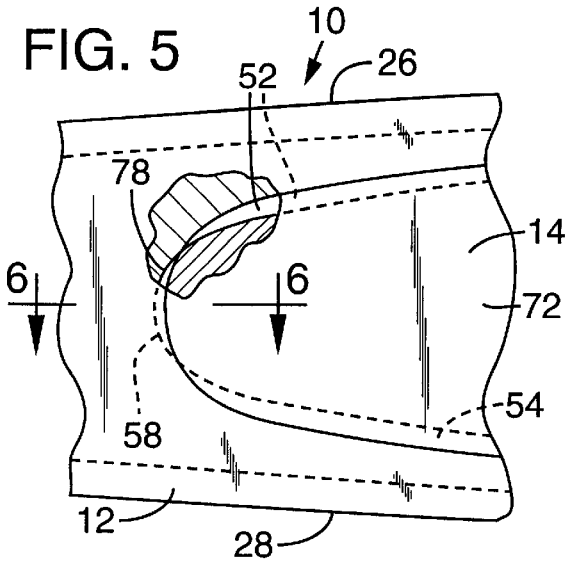
FIG. 5 is an enlarged side elevation view of a portion of the bar of FIG. 1 near the forward, or left, end of FIG. 1.

A pair of elongate flanges 52, 54 (see FIG. 3) extend along upper and lower reaches 40, 42, respectively, and project into the opening substantially centrally of the thickness of the main body portion. The flanges have opposed, laterally outwardly facing surfaces 52*a*, 52*b*, and 54*a*, 54*b*, respectively, which are inset, or spaced laterally inwardly from side surfaces 46, 48. These flanges do not continue fully about the periphery of the opening 34, but terminate somewhat short of the extreme forward and rear ends of the opening as illustrated in FIG. 5.

A socket, also referred to herein as a cavity or recess, 58 (FIGS. 5–7) is formed in the main body portion at the forward end of the opening, with the socket being disposed substantially centrally between the opposed side surfaces 46, 48. The socket is bounded by spaced, opposed side walls 60, 62. Although not illustrated in detail, a similar socket, cavity or recess, 66 is formed in the main body portion at the rear end of the opening, as indicated generally in FIGS. 1 and 2.

Insert 14 is comprised of a pair of substantially mirror-image insert sections 70, 72. The insert sections are substantially planar members, each having a peripheral margin configured to fit closely within the margins of opening 34.

Insert sections 70, 72 have laterally outwardly facing side surfaces 70*a*, 72*a* respectively, and laterally inwardly facing surfaces 70*b*, 72*b*, respectively. Each insert section has a thickness which is less than thickness A of main body portion 12 and the combined thickness of insert sections 70, 72 is no greater than thickness A of main body section 12. Thus the outer side surfaces 70*a*, 72*a* of the insert sections do not extend laterally outwardly beyond the planes occupied by side surfaces 46, 48. In the embodiment illustrated in FIGS. 1–7, each insert has a thickness equal to substantially half of thickness A, such that when faces 70*b*, 72*b* are placed in contiguous face-to-face relationship, outer side surfaces 70*a*, 72*a* are substantially co-planar with side surfaces 46, 48, respectively.

The insert sections have upper marginal edge portions 70*c*, 72*c* and lower marginal edge portions 70*d*, 72*d*. The marginal edge portions are deformed, or machined, to receive and fit closely against the opposed laterally outwardly facing surfaces of flanges 52, 54 as best illustrated in FIG. 3. When assembled as illustrated in FIG. 3, the marginal edge portions of the insert sections rest against opposite side surfaces of the flanges.

Figure 6:
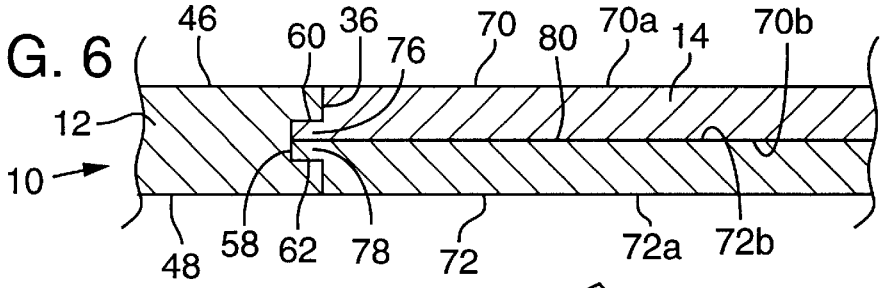
FIG. 6 is an enlarged cross-sectional view taken generally along the line 6—6 in FIG. 5.
Figure 7:
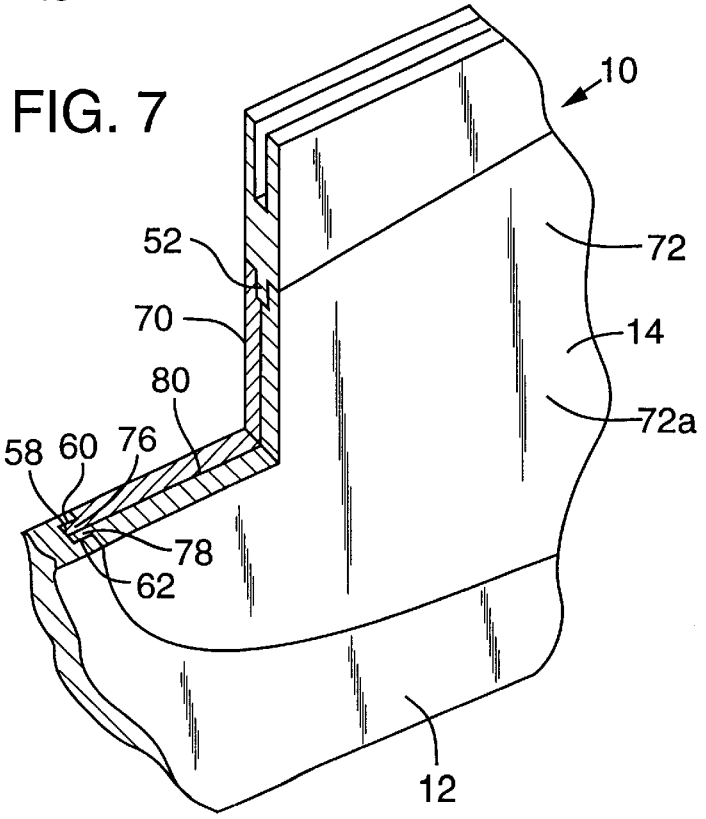
FIG. 7 is an enlarged perspective view of a portion of the bar of FIG. 1, illustrating the manner in which insert sections are held in an opening in a main body portion of the bar.
Figure 8:
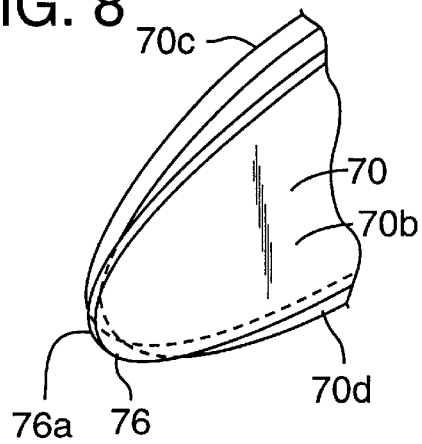
FIG. 8 is an enlarged perspective view taken from an inwardly facing side of an end portion of one insert section of FIG. 2.
Figure 9:
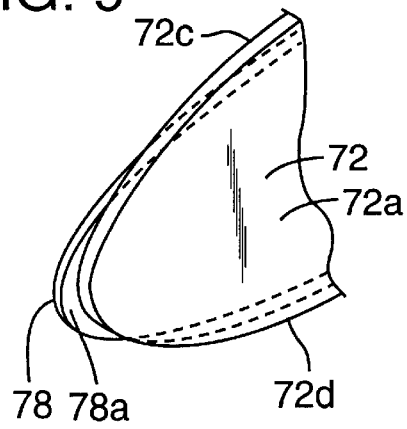
FIG. 9 is an enlarged perspective view taken from an outwardly facing side of an end portion of the other of the insert sections of FIG. 2.

Referring to FIGS. 5–9, each insert section has a tab, or protrusion, extending longitudinally outwardly from remainder portions of the insert section. Such tab is indicated generally at 76 for insert section 70 and at 78 for insert section 72. These tabs, or protrusions, are configured to be received and fit within socket 58. As is best illustrated in FIG. 9, each tab, or protrusion, has an inset side surface, such as 78*a* for tab 78, facing in the same direction as the outer side surface of its associated insert section and is inset laterally therefrom. As best seen in FIG. 6, protrusions 76, 78 are received in socket 58 with their inset side surfaces resting against side walls 60, 62 of socket 58. This acts as a holding mechanism, or retaining means, which is operable to inhibit release of the end portions of the insert sections from the main body portion laterally of the main body portion.

Although not shown in detail in the illustrations, it should be understood that similar protrusions, or tabs, as indicated generally at 77, 79 in FIG. 2, are provided at the rear end of insert sections 70, 72 and are similarly received and held in socket 66 at the rear end of opening 34.

In this embodiment, and referring to FIG. 3, a layer of adhesive 80 applied between the contiguous facing inner side surfaces 70*b*, 72*b* of the insert section adheres them together. They are secured together along a plane paralleling and disposed substantially centrally between opposed side surfaces 46, 48 of the main body portion, and thus substantially centrally of the guide bar. Although adhesive is used in the illustrated embodiment, other means for securing the two insert sections together are possible, such as spot welding, riveting, or other known securing methods.

In one embodiment of the invention, the overall guide bar 10 has a length L, a height H and thickness A. Opening 34 and insert 14 each have an overall length which is at least one-third of length L of the overall bar and at least one-half of the height H of the bar. The flanges 52, 54 are substantially centrally located relative to the thickness of the bar, and are approximately one-third of the thickness A of the bar. As an example of thicknesses, the bar may be on the order of 0.180" thick, each insert would have a thickness of approximately 0.090", and flanges 52, 54 would have a width of approximately 0.060".

The manufacture of the bar according to the embodiment thus far described is simple and inexpensive to produce a structurally sound, durable, and effective chain saw guide bar.

The main body portion may be formed in a known manner of high-grade steel commonly used in chain saw guide bars. In the manufacturing process the outer peripheral contour is formed, as is the peripheral groove 30, oil holes 20, and mounting slot 18. Opening 34, with inwardly directed flanges 52, 54 and sockets 58, 66 is formed in the main body portion by known machining processes.

Insert sections 70, 72 are formed from a second and lighter weight material, such as aluminum, by known blanking and coining processes. Other known manufacturing processes, such as machining, also may be used. Although aluminum has been noted as a second material for the inset, other known materials may be used. Preferably these would be metals which would provide the necessary durability and toughness, and yet provide a substantial reduction in weight for the overall guide bar, as compared with previously known guide bars.

Following manufacture of the main body portion 12 and insert sections 70, 72, one of the insert sections is inserted into opening 34. This is easily done by inserting the protrusion, or tab, at one of its ends into the socket at its associated end of the main body portion. For example, for insert 70, protrusion, or tab 76, is inserted into front socket 58. Since the insert sections are configured to fit closely within opening 34, the insert section 70 may be bowed outwardly in a central portion of the length thereof to reduce the overall end-to-end length so that the tab, or protrusion, 77 at its rear end may be inserted into socket 66 at the rear end of opening 34. After this tab has been inserted into socket 66, insert section 70 is allowed to return to its substantially planar configuration as illustrated and its upper and lower marginal edge portions come into close fitting contact with flanges 52, 54.

After insert section 70 is in place, an industrial adhesive, such as Scotch-Weld acrylic adhesive DP-810 made by 3M Company, is applied to inner face surface 70*b* of the insert section.

Insert section 72 then is attached to the opposite side of the main body portion by inserting its front tab, or protrusion, 78 in socket 58, bowing the insert section slightly to allow its rear tab, or protrusion, 79 to be inserted into rear socket 66, and then allowing it to return to a substantially planar configuration with its upper and lower marginal edge portions against flange 52, and its inner face 72*b* contiguous and in face-to-face contact with face 70*b* of insert section 70. In a preferred method, the two insert sections are clamped tightly together by external clamping means and heat is applied to cure the adhesive therebetween. It has been found that raising the temperature of the bond line at the contact surface between the two insert sections to approximately 115° F. for approximately ten minutes provides a full curing of the adhesive, after which the external clamping may be released and the bar will maintain its integrity.

It has been found that placing the bond line between the two insert sections on substantially the central plane of the bar minimizes shear forces on the adhesive bond between the two insert sections should flexing or bending of the guide bar occur. In this way, there is less chance for shear forces to separate the bond between the two insert sections.

With the forward and rear ends of the insert substantially locked into sockets 58, 66 in the front and rear ends of the main body portion, upper and lower marginal edge portions 70*c* 72*c*, 70*d*, 72*d*, fitting closely against opposed faces of flanges 52, 54, and the two insert sections secured to each other, there is little chance that the insert will release from the main bar body portion during use, and thus the integrity of the bar will be maintained.

By using a lighter weight metal material, such as aluminum or other lightweight metal, for the insert section, the overall weight of the guide bar may be substantially reduced providing advantages for the user. With the insert being metal it will be sufficiently durable and able to withstand rough and extended use.

Figure 10:
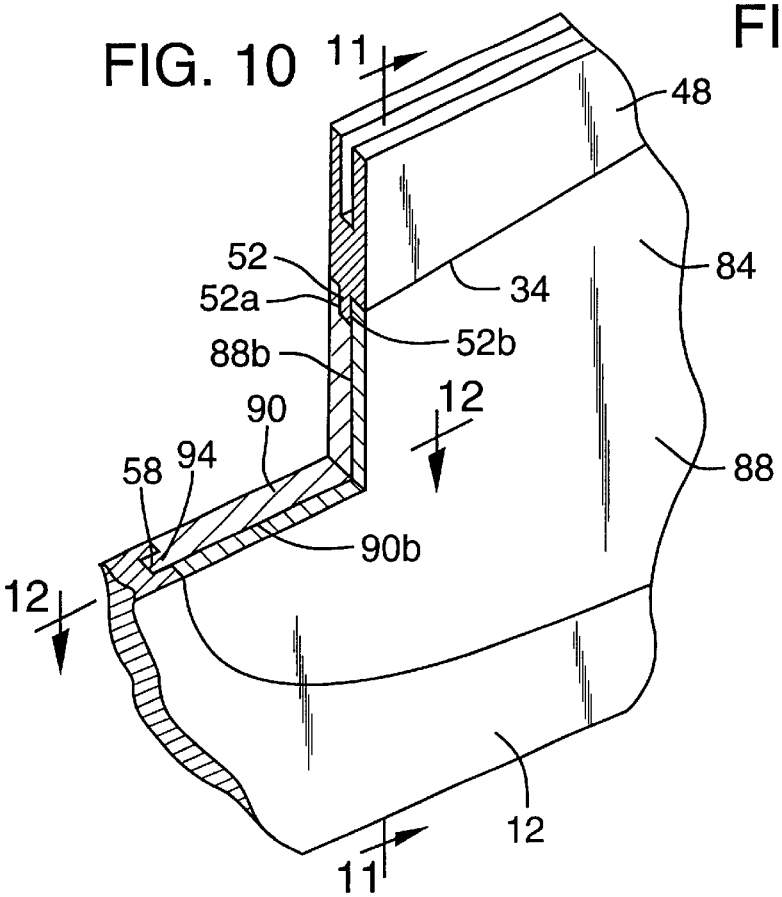
FIG. 10 is an enlarged perspective view, with sections broken away, of a second embodiment of the invention.
Figure 11:
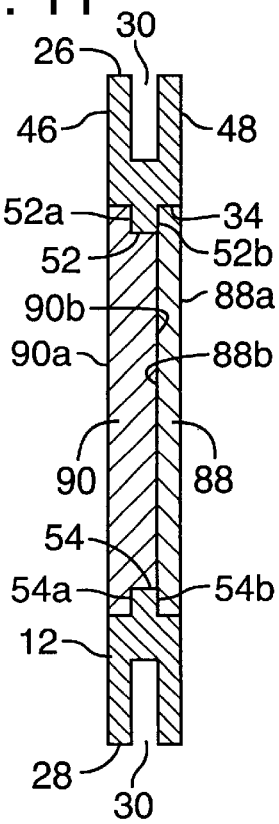
FIG. 11 is a cross-sectional view taken generally along line 11—11 in FIG. 10.
Figure 12:
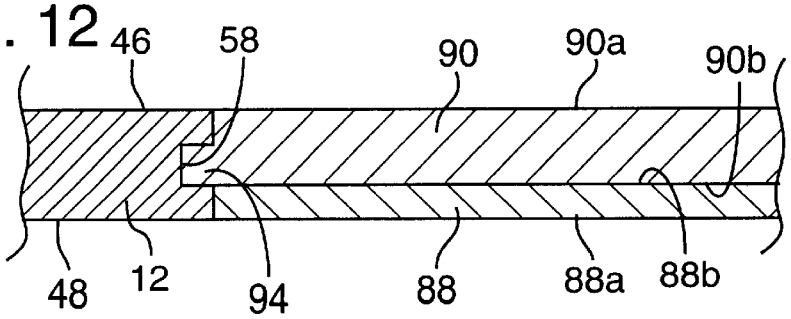
FIG. 12 is an enlarged view taken generally along the line 12—12 in FIG. 10.

Referring to FIGS. 10–12, a second embodiment of the invention is illustrated. Here main body 12 has a configuration similar to that discussed in relation to the first embodiment, but the insert indicated generally at 84 is different. Insert 84 is composed of two insert sections 88, 90, having outwardly facing side surfaces 88*a*, 90*a*, respectively.

In this second embodiment insert section 88 is substantially planar, having a thickness no greater than the distance between outer faces, or sides, 52*b*, 54*b* of flanges 52, 54, and side surface 48 of the main body portion. Insert section 88 would have no tab, or protrusion, at its forward or rear ends.

Insert section 90 also is substantially planar, but has a thickness greater than the thickness of insert 88 and has indentations formed at its upper and lower marginal edges to receive flanges 52, 54, such that it will rest in face-to-face contact with insert section 88. Insert section 90 has a tab, or protrusion, such as that indicated at 94, at its forward and rear ends which are configured to be received and held in sockets 58, 66 at the forward and rear ends, respectively, of opening 34 in the main body portion.

Installation of the inserts involves inserting insert section 90 in opening 34 with the tabs, or protrusions, at its opposite ends received and held in sockets 58, 66, and its upper and lower marginal edge portions resting against surfaces 52*a*, 54*a* of flanges 52, 54. Adhesive is applied to inwardly facing surface 90*b* and surfaces 52*b*, 54*b*. Insert section 88 then is inserted into the opening 34 with its inwardly facing surface 88*b* in face-to-face contact with surface 90*b* of insert section 90, and its upper and lower margin edge portions resting against side surfaces 52*b*, 54*b* of flanges 52, 54. The adhesive is allowed to cure to secure the insert sections in place. As previously noted, other means for securing the insert sections together may be used.

Figure 13:
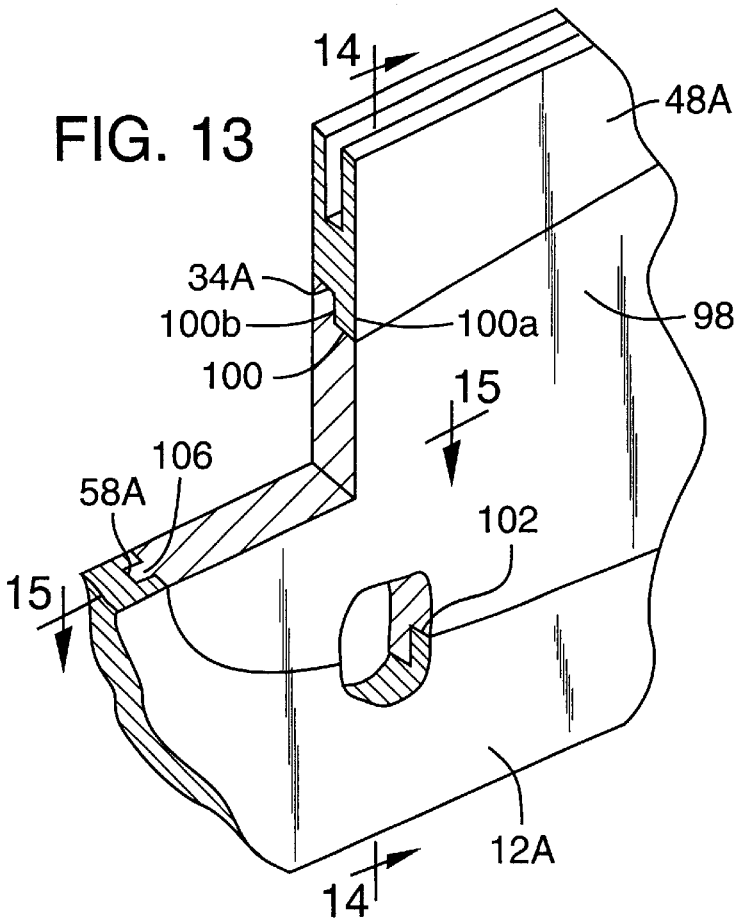
FIG. 13 is an enlarged perspective view, with sections broken away, illustrating a third embodiment of the invention.
Figure 14:
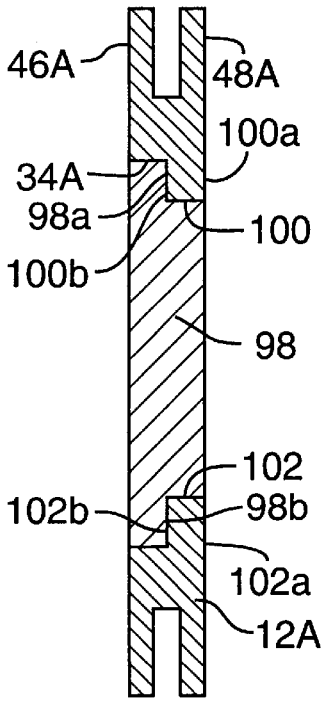
FIG. 14 is a cross-sectional view taken generally along the line 14—14 in FIG. 13.
Figure 15:
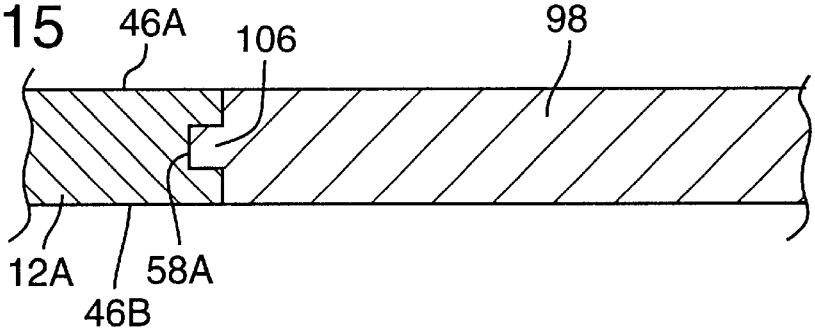
FIG. 15 is an enlarged view taken generally along the line 15—15 in FIG. 13.

Referring to FIGS. 13–15, a third embodiment of the invention is illustrated. Here, main body portion 12A is generally similar to that previously described in relation to FIGS. 1–7. However, as will be seen in FIGS. 13 and 14, opening 34A has upper and lower marginal flanges 100, 102 which extend into the opening with outwardly facing side surfaces 100*a*, 102*a* coplanar with side surface 48A of the main body portion and inwardly facing surfaces 100*b*, 102*b* intermediate opposite side surface 46A, 48A of the main body portion.

The insert 98 has a thickness no greater than the thickness of main body portion 12A and is configured to fit closely within opening 34A and rest against faces 10*b*, 102*b* of the upper and lower flanges. Tabs, or protrusions, such as that indicated at 106 in FIGS. 13 and 15 project from forward and rearward ends of insert 98 to be received and held in sockets such as 58A in the forward and rear ends of opening 34A of the main body portion.

Thus there is only a single insert portion resting closely in opening 34A with upper and lower margin portions 98*a*, 98*b*, resting tightly against surfaces 100*b*, 102*b*, respectively on flanges 100, 102. An adhesive applied between margin portions 98*a*, 98*b* and surfaces 100*b*, 102*b* holds the insert in opening 34A.

Figure 16:
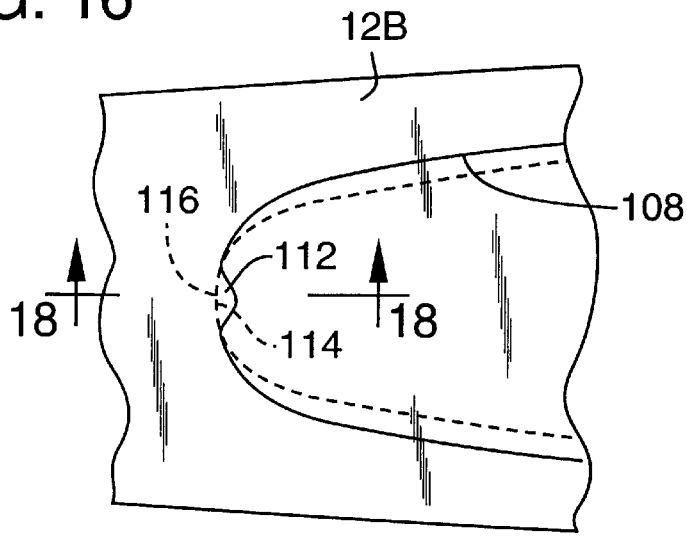
FIG. 16 is a view similar to FIG. 5 of a fourth embodiment of the invention with an insert in the opening of a main body portion.

FIGS. 16–19 illustrate another possible form of tab and socket interconnection between opposite ends of the insert and the main body portion. In the embodiment illustrated in FIGS. 16–19, main body portion of a guide bar indicated generally at 12B has an opening indicated generally at 108 formed therein. Rather than having a generally consistently rounded forward end for the outer portions of the margins of the opening, as previously illustrated for opening 34, here the front and rear ends of the opening are formed as illustrated in FIG. 16, with the opposed face surface portions of the main body portion of the bar formed in a somewhat reverse curve to provide longitudinally inwardly projecting holding wings 110, 112, with a notch, socket, or recess 114 defined therebetween.

Figure 17:
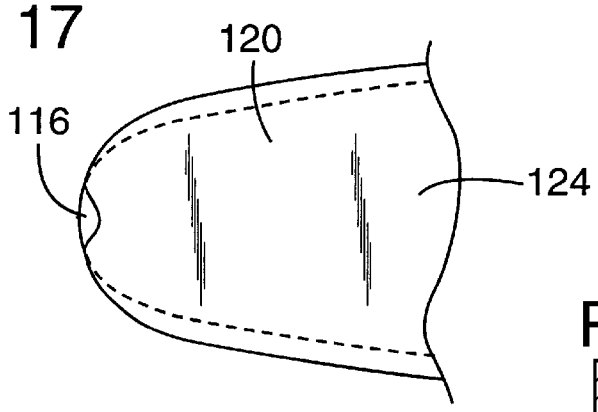
FIG. 17 is a side elevation view of the insert of FIG. 16 removed from the main body portion of the bar.
Figure 19:
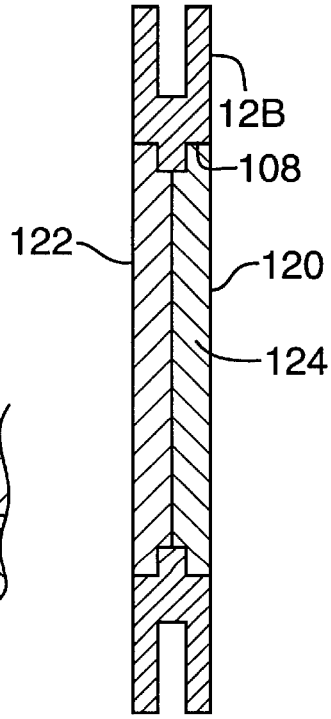
FIG. 19 is a cross-sectional view of FIG. 16.
Figure 18:
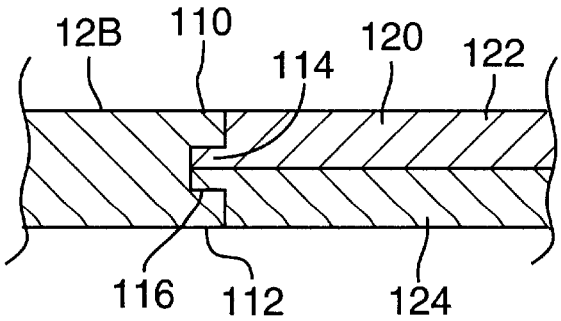
FIG. 18 is a view taken generally along the line 18—18 in FIG. 16.

In FIG. 17 it will be seen that an insert 120 (shown here comprising insert sections 122, 124) has a generally rounded outer configuration nose portion with indentations, such as that indicated generally at 116, configured to receive holding wings 110, 112 to act as retaining, or holding, means or mechanism to hold this associated end of the insert against removal laterally of the bar.

While preferred embodiments of the invention have been described hererein, it should be apparent to those skilled in the field that variations and modifications are possible without departing from the spirit of the invention as set out in the following claims.

What is claimed is:

1. A guide bar for a chain saw comprising an elongate main body portion having opposed side faces, a rear end, a forward end, and elongate upper and lower edges providing a peripheral guide edge for guiding a loop of saw chain to and around the forward end and back to the rear end, said main body portion being made from a first material and having an elongate opening extending laterally through the main body portion intermediate the rear and forward ends and the upper and lower edges, said opening having opposed forward and rear ends and elongate upper and lower reaches, and an elongate insert made from a second material configured to fit closely in said opening, said insert having forward and rear end portions directed toward the forward and rear ends of the main body portion, wherein said insert comprises a first insert section and a second insert section disposed in face-to-face contact with each other, each section configured to fit closely in said opening and having a thickness less than the thickness of the main body portion, said first and second insert sections together having a combined thickness no greater than the thickness of the main body portion, said main body portion having at an end of said opening a holding mechanism for retaining an end portion of said insert to inhibit release of said end portion of the insert from the main body portion laterally of the main body portion, the holding mechanism comprising a socket formed intermediate the opposed side faces of the main body portion and each of the first and second insert sections has a protrusion extending longitudinally from an end of the insert section and received in said socket.

2. The guide bar of claim 1, wherein said first insert section has an outer side surface facing laterally toward one side of the bar, said second insert section has an outer side facing laterally toward the opposite side of the bar, and the protrusion on each of the first and second insert sections has an inset side surface facing in the same direction as the outer side surface of its associated insert section and is inset laterally therefrom.

3. The guide bar of claim 2, wherein the outer side surfaces of the first and second insert sections are substantially co-planar with the opposed side faces of the main body portion.

4. The guide bar of claim 2, wherein said socket is formed at the forward end of the opening and a second socket is formed at the rear end of the opening, and said insert sections have protrusions at both their forward and rear ends received in said sockets.

5. A guide bar for a chain saw comprising an elongate main body portion having opposed side faces, a rear end, a forward end, and elongate upper and lower edges providing a peripheral guide edge for guiding a loop of saw chain to and around the forward end and back to the rear end, said main body portion being made from a first material and having an elongate opening extending laterally trough the main body portion intermediate the rear and forward ends and the upper and lower edges, said opening having opposed forward and rear ends and elongate upper and lower reaches, and an elongate insert made from a second material configured to fit closely in said opening, said insert having forward and rear end portions directed toward the forward and rear ends of the main body portion, said main body portion having at an end of said opening a holding mechanism for retaining an end portion of said insert to inhibit release of said end portion of the insert from the main body portion laterally of the body portion, said holding mechanism comprising a socket formed intermediate the opposed side faces of the main body portion, said socket having a laterally inwardly directed wall to retain one of said end portions of said insert.

6. The guide bar of claim 5, wherein said one end portion of said insert comprises a protrusion extending longitudinally from remainder portions of the insert, and said protrusion is received in said socket.

7. The guide bar of claim 5, wherein said m body portion has a flange projecting into the opening along at least one of the reaches of the opening with a laterally outwardly facing surface, and said insert comprises an elongate longitudinal reach having a laterally inwardly facing marginal edge portion which engages and is supported by the flange.

8. The guide bar of claim 5, wherein said insert comprises a first insert section and a second insert section disposed in face-to-face contact with each other, each section configured to fit closely in said opening and having a thickness less than the thickness of the main body portion, said first and second insert sections together having a combined thickness no greater than the thickness of the main body portion.

9. The guide bar of claim 8, wherein the main body portion comprises a flange projecting into the opening along one of said reaches of the opening, said flange having opposed laterally outwardly facing side surfaces which are inset laterally from outer side surfaces of the main body portion, and marginal edge portions of the first and second insert sections engage and are supported by the opposed side surfaces of the flange.

10. The guide bar of claim 9, wherein said first and second insert sections are configured to permit central portions thereof to rest in contact with each other while marginal edge portions thereof engage the flange and the laterally outwardly facing side surfaces of the first and second insert sections have a combined thickness no greater than the thickness of the main body portion.

11. The guide bar of claim 10, wherein outer side surfaces of the first and second insert sections are substantially co-planar with the opposed side faces of the main body portion.

12. The guide bar of claim 8, wherein a socket is formed at both the forward and rear ends of the opening in the main body portion and said first and second insert sections have portions at both their forward and rear ends which are received in said sockets.

13. The guide bar of claim 1, wherein said second material is lighter weight than said first material.

14. The guide bar of claim 13, wherein said first material is steel and said second material is aluminum.

15. The guide bar of claim 5, wherein said main body portion has a first length between its forward and rear ends, and said opening and said insert each have a length which is at least one third of said first length.

16. The guide bar of claim 5, wherein said main body portion has a first height between its upper and lower edges and said opening and said insert each have a height which is at least one half the first height.

17. The guide bar of claim 5, wherein said insert comprises a first insert section and a second insert section disposed in face-to-face contact with each other, each section having a thickness less than the thickness of the main body portion and together having a combined thickness no greater than the thickness of the main body portion, and said first and second insert sections are secured together.

18. The guide bar of claim 17, which further comprises an adhesive interposed between said first and second insert sections to bond said sections together.

19. The guide bar of claim 17, wherein said first and second insert sections have contiguous inner faces which contact each other along a plane paralleling and disposed substantially centrally between the opposed side faces of the main body portion.

20. A guide bar for a chain saw comprising an elongate main body portion having opposed side faces, a rear end, a forward end, and elongate upper and lower edges providing a peripheral guide edge for guiding a loop of saw chain to and around the forward end and back to the rear end, said main body portion being made from a first material and having an elongate opening extending laterally through the main body portion intermediate the rear and forward ends and the upper and lower edges, said opening having opposed forward and rear ends and elongate upper and lower reaches, and an elongate insert made from a second material configured to fit closely in said opening, said insert having forward and rear end portions directed toward the forward and rear ends of the main body portion, wherein said insert comprises a first side surface facing laterally outwardly to one side of the guide bar and a protrusion extending longitudinally from remainder portions of the insert, said protrusion having an inset surface facing in the same direction as the first side surface and inset laterally from said first side surface, said main body portion having at an end of said opening holding a mechanism for retaining an end portion of said insert to inhibit release of said end portion of the insert from the main body portion laterally of the main body portion, the holding mechanism comprising a socket formed intermediate the opposed side faces of the main body portion and said protrusion is received in said socket.

21. A guide bar for a chain saw comprising an elongate main body portion having opposed side faces, a rear end, a forward end, and elongate upper and lower edges providing a peripheral guide edge for guiding a loop of saw chain to and around the forward end and back to the rear end, said main body portion being made from a first material and having an elongate opening extending laterally through the main body portion intermediate the rear and forward ends and the upper and lower edges, said opening having opposed forward and rear ends and elongate upper and lower reaches, and a flange projects into the opening along at least one of the reaches of the opening with a laterally outwardly facing surface, and an elongate insert made from a second material configured to fit closely in said opening, said insert having forward and rear end portions directed toward the forward and rear ends of the main body portion and an elongate longitudinal reach having a laterally inwardly facing marginal edge portion which engages and is supported by said flange, said main body portion having a socket formed therein at an end of said opening and intermediate the opposed side faces of the main body portion, said socket receiving and holding an end portion of said insert to inhibit release of said end portion from the main body portion laterally of the main body portion.

22. The guide bar of claim 21, wherein said insert comprises a first insert section and a second insert section disposed in face-to-face contact with each other, each section configured to fit closely in said opening and having a thickness less than the thickness of the main body portion, said first and second insert sections together having a combined thickness no greater than the thickness of the main body portion.

23. The guide bar of claim 22, wherein each of the first and second insert sections has a protrusion extending longitudinally from an end of the insert section and received in said socket.

24. The guide bar of claim 22, wherein said socket is formed at the forward end of the opening and a second socket is formed at the rear end of the opening, and said insert sections have protrusions at both their forward and rear ends received in said sockets.

25. The guide bar of claim 21, wherein said second material is lighter weight than said first material.

26. The guide bar of claim 21, wherein said first material is steel and said second material is aluminum.

27. The guide bar of claim 21, wherein said insert comprises a first insert section and a second insert section disposed in face-to-face contact with each other, each section having a thickness less than the thickness of the main body portion and together having a combined thickness no greater than the thickness of the main body portion, and said first and second insert sections are secured together.

28. The guide bar of claim 27, which further comprises an adhesive interposed between said first and second insert sections to bond said sections together.

29. The guide bar of claim 27, wherein said first and second insert sections have contiguous inner faces which contact each other along a plane paralleling and disposed substantially centrally between the opposed side faces of the main body portion.

30. A guide bar for a chain saw comprising an elongate main body portion having opposed side faces, a rear end, a forward end, and elongate upper and lower edges, said main body portion being made from a first material and having an elongate opening extending laterally therethrough, said opening having opposed forward and rear ends and opposed elongate upper and lower reaches spaced inwardly from the forward and rear ends and the upper and lower edges of the main body portion, and an elongate insert made from a second material configured to fit closely in said opening, said insert having forward and rear end portions directed toward the forward and rear ends of the main body portion, said main body portion having at an end of said opening retaining means operable to inhibit release of one of said end portions of the insert from the main body portion laterally of the main body portion, said retaining means comprising a socket formed intermediate the opposed side faces of the main body portion, said socket having a laterally inwardly directed wall to retain an end portion of said insert.

31. The guide bar of claim 30, wherein an end portion of said insert comprises a protrusion extending longitudinally from remainder portions of the insert, and said protrusion is received in said socket.

32. The guide bar of claim 30, wherein said main body portion has a flange projecting into the opening along at least one of the reaches of the opening with a laterally outwardly facing surface, and said insert comprises an elongate longitudinal reach having a laterally inwardly facing marginal edge portion which engages and is supported by the flange.

33. The guide bar of claim 30, wherein sad insert comprises a first insert section and a second insert section disposed in face-to-face contact with each other, each section configured to fit closely in said opening and having a thickness less than the thickness of the main body portion, said first and second insert sections together having a combined thickness no greater than the thickness of the main body portion.

34. The guide bar of claim 33, wherein said retaining means comprises a socket formed intermediate the opposed side faces of the main body portion and each of the first and second insert sections has a protrusion extending longitudinally from an end of the insert section and received in said socket.

35. The guide bar of claim 34, wherein said socket is formed at the forward end of the opening and a second socket is formed at the rear end of the opening, and said insert sections have protrusions at both their forward and rear ends received in said sockets.

36. The guide bar of claim 30, wherein said insert comprises a first insert section and a second insert section disposed in face-to-face contact with each other, each section having a thickness less than the thickness of the main body portion and together having a combined thickness no greater than the thickness of the main body portion, and said first and second insert sections are secured together.

37. The guide bar of claim 36, wherein said first and second insert sections have contiguous inner faces which contact each other along a plane paralleling and disposed substantially centrally between the opposed side faces of the main body portion.

38. A method for making a guide bar for a chain saw comprising the steps of providing an elongate substantially planar main body portion made of a first material having opposed side faces, a forward end, a rear end, and elongate upper and lower edges for guiding a loop of saw chain, forming an elongate opening extending laterally through the main body portion with margins of the opening spaced inwardly from the forward and rear ends and the upper and lower edges, providing an elongate substantially planar insert made from a second material configured to fit closely in said opening, said insert having forward and rear end portions, forming a socket in said main body portion at an end of said opening intermediate the opposed side faces of the main body portion, the socket being sized to receive and hold an end portion of said insert, placing said insert in said opening with an end portion of the insert received in said socket to inhibit release the end portion of said insert from the main body portion laterally of the bar.

39. The method of claim 38, wherein said socket is formed in a forward end of said opening and receives the forward end portion of the insert, and which further comprises the steps of forming a second socket in said main body portion at a rear end of said opening intermediate the opposed side faces of the main body portion, said second socket sized to receive and hold an end portion of said insert, and placing the rear end portion of the insert in said second socket.

40. The method of claim 39, wherein said opening has an elongate reach and which further comprises the steps of providing a flange on said main body portion projecting into said opening along said reach, the flange having a side surface inset laterally from a face of said main body portion, and placing a marginal edge portion of the insert against said side surface of the flange to support the insert in said opening.

41. The method of claim 39, wherein the insert is formed with a major portion thereof having an outer margin configuration complementary to the margin configuration of the opening and further having protrusions extending longitudinally from the forward and rear end portions thereof sized to fit closely in said sockets, and the step of placing the insert in said opening comprises the steps of inserting one of said protrusions into one of the sockets, bowing a central section of the insert laterally outwardly to reduce the distance between the protrusions, inserting the other of said protrusions into the other of the sockets, and allowing the insert to return to its substantially planar configuration to seat the protrusions in the sockets.

42. The method of claim 41, wherein the insert comprises a first insert section having a thickness less than the thickness of said main body portion, and further comprises the steps of providing a second insert section having a thickness less than the thickness of the main body portion, the first and second insert sections having a combined thickness no greater than the thickness of the main body portion, providing protrusions at forward and rear ends of both insert sections configured to be received in said sockets, placing said first insert section in said opening from one side of the main body portion with its forward and rear protrusions in said sockets, placing said second insert section in said opening from the opposite side of the main body portion with its forward and rear protrusions in said forward and rear sockets and said first and second insert sections being disposed with contiguous surfaces thereof in face-to-face contact, and securing said first and second insert sections together.

43. The method of claim 42, which further comprises the step of introducing an adhesive between said contiguous surfaces of said first and second insert sections to bond them together.

44. The method of claim 42, wherein said first and second insert sections are positioned in the opening of the main body portion with their contiguous surfaces adjacent a plane which is parallel to and substantially centrally disposed between opposed side faces of the main body portion.

* * * * *

UNITED STATES PATENT AND TRADEMARK OFFICE

CERTIFICATE OF CORRECTION

PATENT NO. : 6,427,342 B1
DATED : August 6, 2002
INVENTOR(S) : Breitbarth et al.

It is certified that error appears in the above-identified patent and that said Letters Patent is hereby corrected as shown below:

Column 7,
Line 26, “10b” should be -- 100b --.

Column 8,
Line 57, “trough” should be -- through --.

Column 9,
Line 12, “m body portion” should be -- main body portion --.

Signed and Sealed this

Fourth Day of March, 2003

JAMES E. ROGAN
*Director of the United States Patent and Trademark Office*